United States Patent [19]

Coman

[11] Patent Number: 4,658,776

[45] Date of Patent: Apr. 21, 1987

[54] ROTARY VALVE INTERNAL COMBUSTION ENGINE

[76] Inventor: Clyde R. Coman, 6823 S. 121st West Ave., Sapulpa, Okla. 74066

[21] Appl. No.: 825,641

[22] Filed: Feb. 3, 1986

[51] Int. Cl.[4] ..... F01L 7/02

[52] U.S. Cl. ..... 123/190 BD; 123/80 BA

[58] Field of Search ..... 123/190 BD, 190 BF, 123/190 B, 190 BA, 190 BB, 80 BA

[56] References Cited

U.S. PATENT DOCUMENTS

| | | | |
|---|---|---|---|
| 1,616,029 | 2/1927 | Dock | 123/190 BD |
| 1,616,030 | 2/1927 | Dock | 123/80 BA |
| 1,777,464 | 10/1930 | Edwards | 123/190 BD |
| 1,977,025 | 10/1934 | Vander Elst et al. | 123/190 BD |
| 2,249,143 | 7/1941 | Kisel et al. | 123/190 BD |
| 3,192,914 | 7/1965 | Kopczyk | 123/190 BD |
| 3,871,340 | 3/1975 | Zimmerman | 123/190 BD |
| 4,517,938 | 5/1985 | Krüger | 123/190 BA |

*Primary Examiner*—Ira S. Lazarus

*Attorney, Agent, or Firm*—William S. Dorman

[57] ABSTRACT

A rotary valve internal combustion engine including a cylinder block having a cylindrical recess, a cylindrical bore transverse to the cylindrical recess, an exhaust passageway leading from the cylindrical bore, and an intake passageway leading to the cylindrical bore. A cylindrical piston sealably reciprocates in the cylindrical recess so that the space defined by the top of the piston and the walls of the cylindrical recess forms a combustion chamber. An arcuate passageway in the block extends between the cylindrical bore and the combustion chamber. A crankshaft is connected to the piston. An ignition system is in communication with the combustion chamber. A carburetor to provide a fuel-air mixture is in communication with the intake passageway. A cylindrical valve, rotatably received in the cylindrical bore, has a hollow body, open ends, two axially aligned intake ports near one end of the cylindrical body, two axially aligned exhaust ports near the opposite end of the cylindrical body, four axially aligned arcuate center openings located between the exhaust ports and the intake ports, and four internal tubes, each tube connecting a center opening with an intake or exhaust port. A sprocket wheel extends from one end of the cylindrical valve and is connected to the crankshaft by a tooth belt. The reciprocating piston rotates the valve to first allow the fuel-air mixture to enter the combustion chamber and then allow burnt gases to be expelled from the combustion chamber.

3 Claims, 7 Drawing Figures

ROTARY VALVE INTERNAL COMBUSTION ENGINE

BACKGROUND OF THE INVENTION

1. Field of the Invention

The present invention relates to an internal combustion engine employing an improved rotary valve to control admission of fuel and to control exhaustion of burned gases.

2. Prior Art

In an internal combustion engine, each cycle consists of a series of events which are repeated in regular order. Initially, a fresh charge of a gas and air mixture is admitted into the combustion chamber. The explosive mixture is then compressed by action of the piston and the mixture ignited. The ignited charge expands rapidly, moving the piston. Finally, the burned gases are expelled from the combustion chamber and the cycle begins again.

The use of a rotary valve in an internal combustion engine is simpler than the traditional arrangement of a cam, push rod and valve springs. Rotary valves have been experimented with in the past to regulate the admission of fuel to the combustion chamber and the exhaustion of burned gases from the combustion chamber; previous systems, however, have not met with commercial success since they have not been as simple and efficient as the present system.

A principal object of the present invention is to provide an improved valving arrangement for an internal combustion engine which is resistant to wear and has a minimum of moving parts.

A further object of the present invention is to provide an internal combustion engine having a single-piece head and block, eliminating the need for a head gasket.

A patentability search was conducted on the present invention and the following U.S. patents were uncovered in the search:

| U.S. Pat. No. | Patentee | Issue Date |
|---|---|---|
| 1,079,742 | Calkins et al. | November 25, 1913 |
| 1,108,002 | Ransom | August 18, 1914 |
| 1,616,030 | Dock | February 1, 1927 |
| 2,249,143 | Kiesel | July 15, 1941 |
| 3,192,914 | Kopczyk | July 6, 1965 |

Calkins and Johnson (U.S. Pat. No. 1,079,742) discloses a rotary valve for an internal combustion engine but requires a separate head and block. The present invention provides an improved single piece head and block, without need of a head gasket. Additionally, air-cooling the valve as shown in the present invention is superior to the Calkins and Johnson system of liquid cooling.

While Dock (U.S. Pat. No. 1,616,030) discloses a rotary valve for an internal combustion engine, the oscillating head is cumbersome and impractical. Further, use of a passageway through the valve for the ignition spark is unduly complicated and unnecessary.

SUMMARY OF THE INVENTION

The present invention involves an internal combustion engine with a rotary valve received in a cylindrical bore provided on a cylinder block. An exhaust passageway extends through the cylinder block to the cylinder bore. An intake passageway extends through the cylinder block to the cylindrical bore. The intake passageway connects with the usual carburetor for supplying an air-gas mixture.

A cylindrical recess in the cylinder block is transverse to the cylindrical bore. An arcuate passageway extends between and connects the cylindrical bore and the cylindrical recess. A cylindrical piston is allowed to sealably reciprocate in the cylindrical recess. A sprocket wheel is provided on a crankshaft which is connected to the piston by a piston rod.

The space defined by the top of the piston and the walls of the cylindrical recess forms a combustion chamber. A spark plug, mounted on the block, is in communication with the combustion chamber.

One end of the valve extends beyond the cylindrical bore and is provided with a sprocket wheel. The crankshaft sprocket wheel is connected to the valve sprocket wheel by a tooth belt.

The valve, a hollow cylinder with open ends, has two intake ports axially juxtaposed near one end. As the valve rotates, the intake ports alternately align with the exhaust passageway. Two exhaust ports are axially juxtaposed near the opposite end of the valve. As the valve rotates, the exhaust ports will alternately align with the exhaust passageway. Four axially juxtaposed arcuate center openings are provided on the valve between the intake and exhaust ports. As the valve rotates, the center openings will successively align with the arcuate passageway in the block.

Four internal tubes traverse the valve. Two internal tubes connect the intake ports with center openings. Two internal tubes connect the exhaust ports with center openings.

The valve continuously rotates during each of the engine's four strokes at one-quarter crankshaft speed: intake, compression, power and exhaust. During the intake stroke, the valve allows the fuel-air mixture to be admitted into the combustion chamber. During the compression and power strokes, the valve closes and seals the combustion chamber. During the exhaust stroke, the valve allows the burned gases to be expelled from the combustion chamber.

DETAILED DESCRIPTION OF THE PREFERRED EMBODIMENTS

Figure 1:
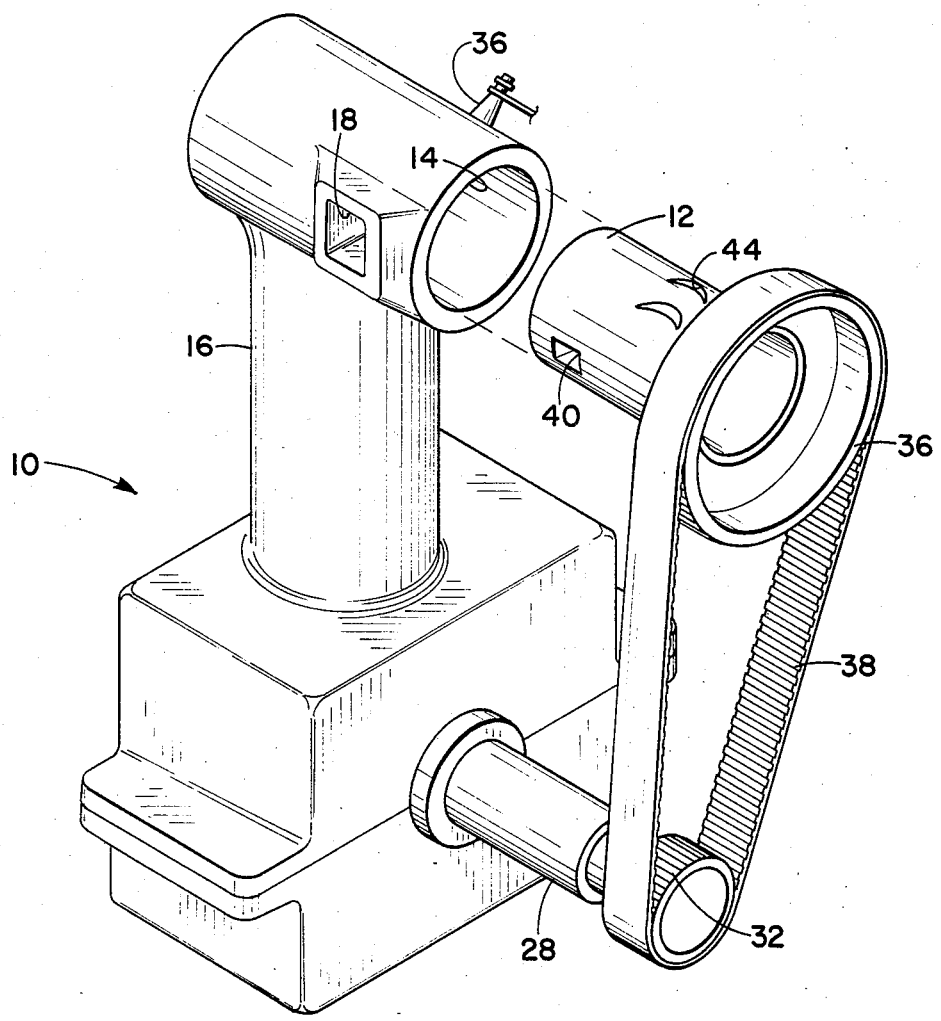
FIG. 1 is a view in perspective of an internal combustion engine constructed according to the present invention having a rotary valve shown exploded from the engine.

Referring to the drawings in detail, FIG. 1 shows an exploded view of an internal combustion engine 10 with a rotary valve 12 apart from the engine. The supporting starting, ignition, fuel and lubricating systems would be of the usual variety and are not shown.

In the usual known engine, a cylinder head is secured to the top of the block in order to trap the energy of combustion so that it will be exerted on the piston. Problems often arise due to the interface between head and block. Obtaining a tight seal is a problem. The gasket also prevents transfer of heat to the block. Eliminating the head and the gasket through a one-piece cylinder block design is thus desirable.

The valve 12 in the present invention is rotatably received in a cylindrical bore 14 in a cylinder block 16. The cylindrical bore can be seen in cross section in FIG. 2.

An exhaust passageway 18 extends from the cylindrical bore 14 in the cylinder block 16. An intake passageway 20 (not seen in FIG. 1) extends through the cylinder block 16 to the cylindrical bore 14. The intake passageway 20 connects with the usual careburetor (not shown) for converting liquid fuel to an air-gas mixture.

Figure 3:
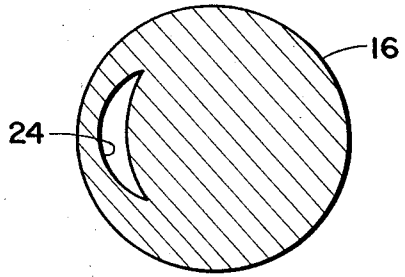
FIG. 3 is a section view taken along section line 3—3 of FIG. 2.
Figure 2:
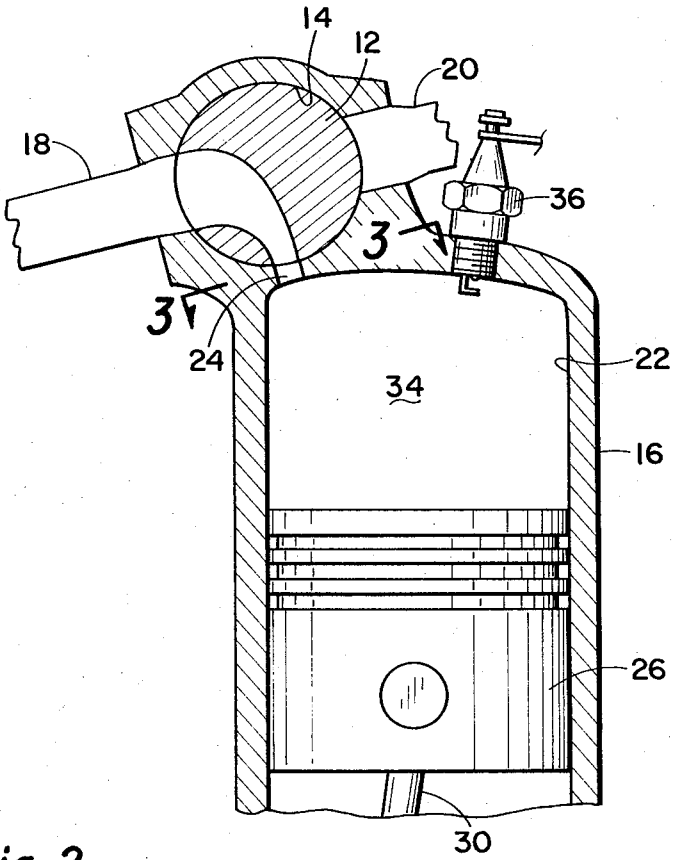
FIG. 2 is a section view, on an enlarged scale of the internal combustion engine shown in FIG. 1 with the rotary valve removed.

As seen in FIG. 2, a cylindrical recess 22 in the cylinder block is transverse to the cylindrical bore 14. The valve 12 is shown in cross-section in FIG. 2. An arcuate passageway 24 extends between and connects the cylindrical bore and the cylindrical recess 22. The arc of the passageway 24 follows generally the wall of the cylindrical recess, as best seen in FIG. 3. A cylindrical piston 26 is allowed to sealably reciprocate in the cylindrical recess. The piston is connected to a crankshaft 28 by a piston rod 30. A sprocket wheel 32 is provided on the crankshaft.

The space defined by the top of the piston 26 and the walls of the cylindrical recess 22 forms a combustion chamber 34. A spark plug 36, mounted on the block 16, is in communication with the combustion chamber 34. The spark plug, in turn, is connected to the balance of the ignition system (not shown). The piston 26, piston rod 30, crankshaft 28 and spark plug 36 are standard equipment in most internal combustion engines today.

Returning to a consideration of FIG. 1, one end of the valve 12 extends beyond the cylindrical bore 14 and is provided with a sprocket wheel 36. The crankshaft sprocket wheel 32 is connected to the valve sprocket wheel 36 by a tooth belt 38. The sprocket wheels are of such dimensions that the valve rotates at one-quarter crankshaft speed. The valve 12 is thus rotated one turn for each four turns of the crankshaft 28.

Figure 4:
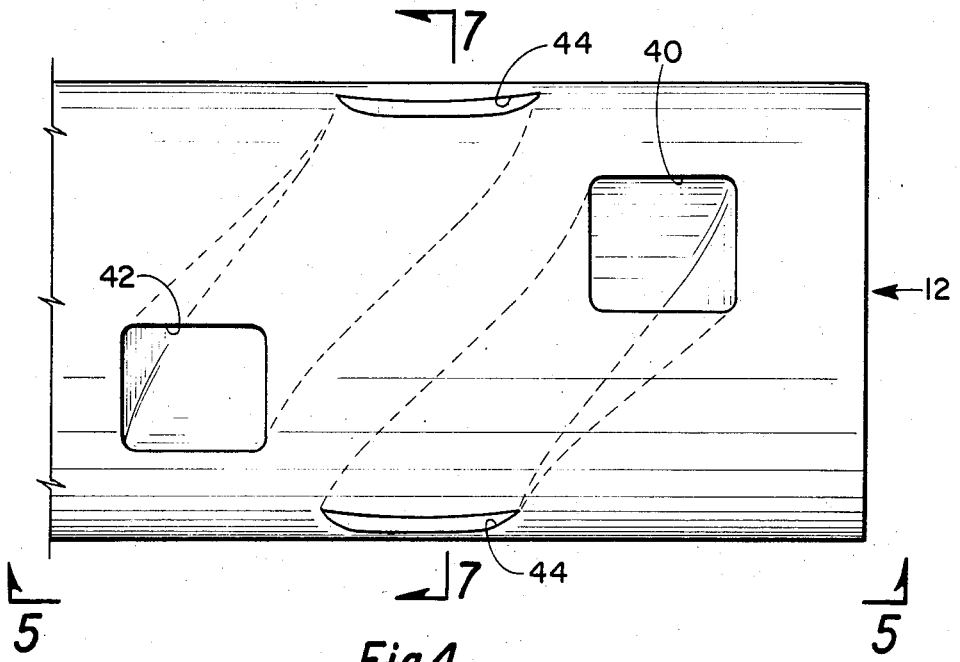
FIG. 4 is an enlarged view of the rotary valve apart from the internal combustion engine shown in FIG. 1.
Figure 5:
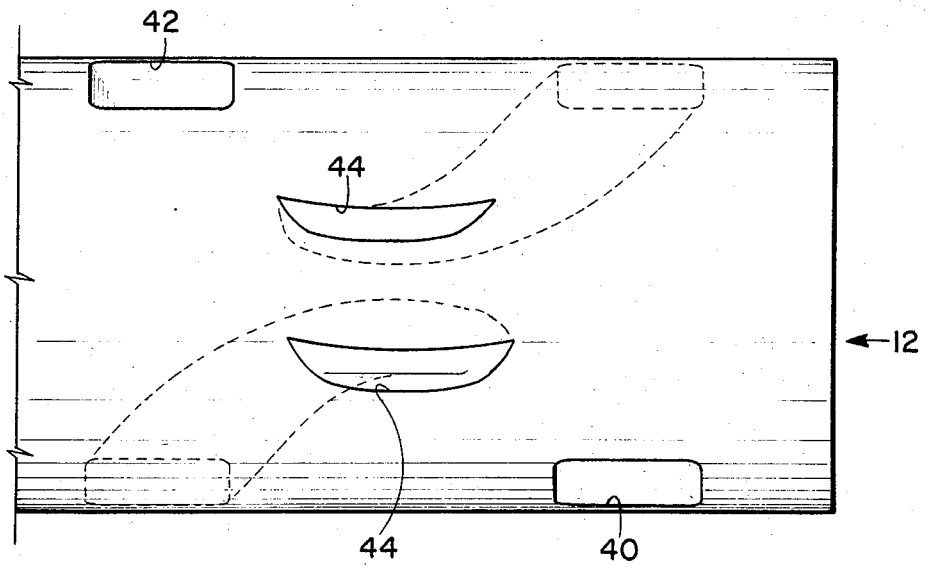
FIG. 5 is an enlarged view of the rotary valve taken along section line 4—4 of FIG. 3.
Figure 6:
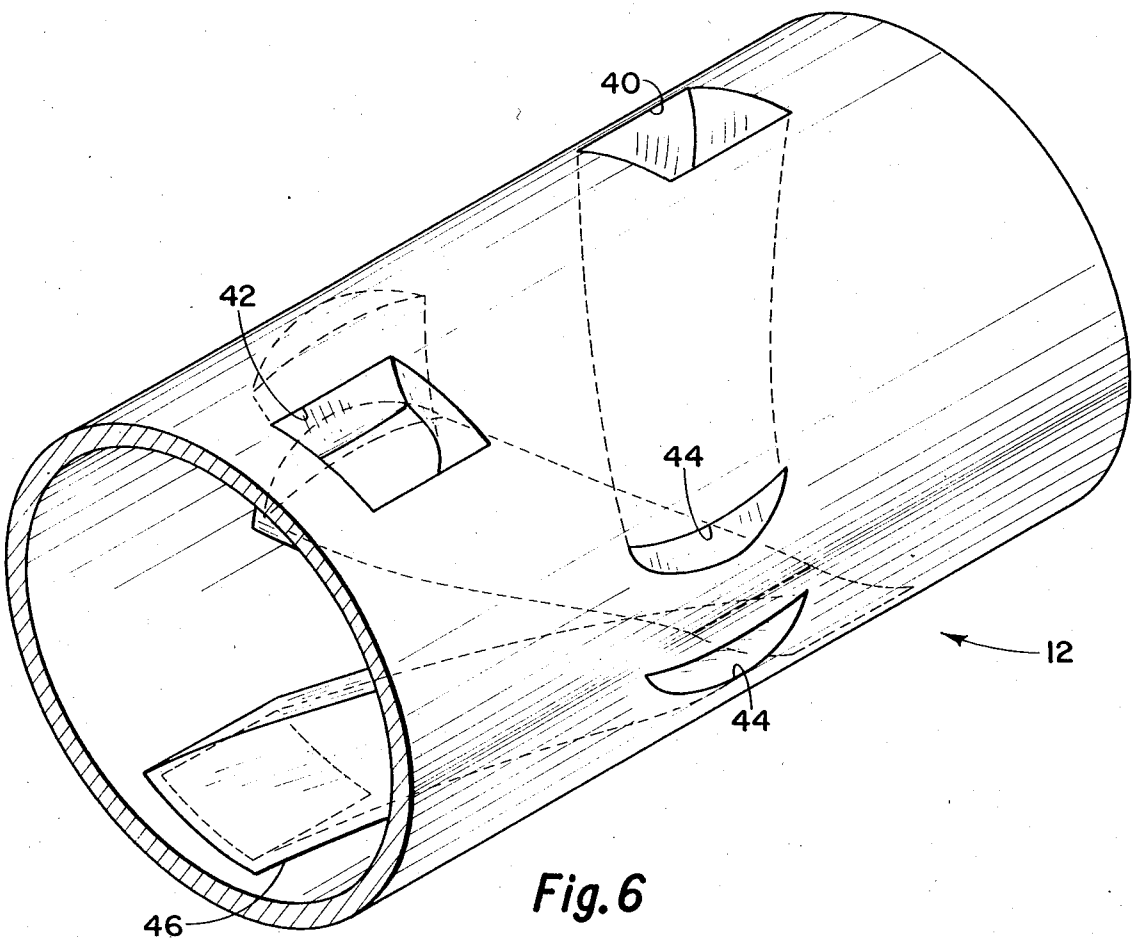
FIG. 6 is a perspective view of the rotary valve shown in FIG. 3.

The valve 12, a hollow cylinder with open ends, has a plurality of ports as best seen in FIGS. 4, 5 and 6. Two intake ports 40 are axially juxtaposed near one end of the valve 12. As the valve rotates, the intake ports will alternately align with the intake passageway 20. Two exhaust ports 42 are axially juxtaposed near the opposite end of the valve 12. As the valve rotates, the exhaust ports will alternately align with the exhaust passageway 18. Four axially juxtaposed arcuate center openings 44 are provided on the valve between the intake and exhaust ports. As the valve rotates, the center openings 44 will successively align with the arcuate passageway 24 in the block 16.

Figure 7:
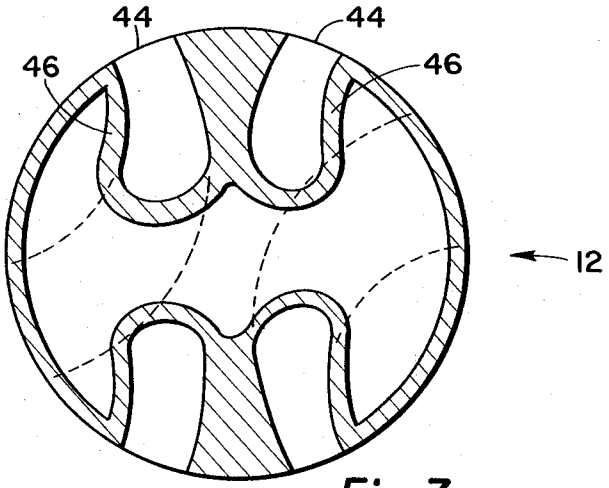
FIG. 7 is a cross-section view of the rotary valve taken along section line 6—6 of FIG. 3.

Four internal tubes 46 traverse the valve. Two internal tubes connect the intake ports 40 with center openings 44. Two internal tubes connect the exhaust ports 42 with center openings 44. As best seen in FIGS. 5 and 7, the construction of the valve with a hollow body and open ends allows air-cooling of the valve 12 and its tubes 46.

When operating, the engine 10 goes through four separate strokes or actions: intake, compression, power and exhaust. The valve 12, driven by reciprocating action of the piston, rotates during each of the engine's four strokes.

As the piston 26 moves downward on the intake stroke, the crankshaft 26 is rotated, rotating the valve 12 so that one of the intake ports 40 is aligned with the intake passageway 20. At the time the intake port 40 is aligned with the intake passageway 20, the accompanying center opening 44 aligns with the arcuate passageway 24. A mixture of fuel and air (not shown) is thus allowed to enter the combustion chamber 24 by traveling from the carburetor (not shown), past the intake passageway 20, past the intake port 40 on the valve, through the internal tube 46, past the center opening 44 and through the arcuate passageway 24. During this intake stroke, a partial vacuum is created as the piston travels down. As seen in FIG. 2, the arcuate passageway 24 is connected to the combustion chamber near one edge of the cylindrical recess 22. The placement of the arcuate passageway relative to the combustion chamber and the shape of the passageway will tend to give the fuel-air mixture a swirl. Thus, the fuel-air mixture is caused to circulate in the combustion chamber.

On the compression stroke, the valve 12 continues to rotate, closing and sealing the combustion chamber. As the piston moves upward, the fuel-air mixture is compressed while continuing to circulate in the combustion chamber.

As the piston 26 nears the top of the compression stroke, the spark plug ignites, causing a firing or exploding of the compressed air-fuel mixture. The valve 12, continuing its rotation, is in the closed position and the piston is driven down during this power stroke.

On the exhaust stroke, the piston 26 moves upward and the valve 12 continues its rotation so that one of the exhaust ports 42 is aligned with the exhaust passageway 18. The accompanying center opening 44 aligns with the arcuate passageway 24. The burned gases (not shown) are thus allowed to escape out of the combustion chamber 34, through the arcuate passageway 24, past the center opening 44, through internal tube 46, past the exhaust port 42 and through exhaust passageway 18. As the piston nears its uppermost position, the cycle begins again.

As can be appreciated, the present embodiment discloses a single cylinder and a single valve; a number may be combined together, as in the case of a multi-cylinder automobile engine.

Whereas, the present invention has been described in particular relation to the drawings attached hereto, it should be understood that other and further modificatins, apart from those shown or suggested herein, may be made within the spirit and scope of this invention.

What is claimed is:

1. A rotary valve internal combustion engine which comprises: a cylinder block having a cylindrical recess therein, a cylindrical bore transverse to said cylindrical recess, an exhaust passageway leading from said cylindrical bore, and an intake passageway leading to said cylindrical bore; a cylindrical piston sealably reciprocable in said cylindrical recess wherein the space defined by said piston and the walls of said cylindrical recess forms a combustion chamber; an arcuate passageway in said block between said cylindrical bore and said combustion chamber; a crankshaft connected to said piston; ignition means in communication with said combustion chamber; carburetion means in connection with said intake passageway to provide a fuel-air mixture; a cylindrical valve rotatably received in said cylindrical bore, said cylindrical valve having a hollow cylindrical body, open ends, at least two axially aligned intake ports near one end of said cylindrical body, at least two axially aligned exhaust ports near the opposite end of said cylindrical body, at least four axially aligned arcuate center openings between said exhaust ports and said intake ports, and at least for internal tubes, each tube connecting one of said center openings with one of said intake or exhaust ports; a sprocket wheel extending from one end of said cylindrical valve; and a tooth belt extending between said sprocket wheel and said crankshaft, whereby rotation of said valve by reciprocation of said piston first brings an intake port on said valve in communication with said intake passageway and said accompanying center opening in communication with said arcuate passageway to allow said fuel-air moisture to enter said combustion chamber and then brings an exhaust port on said valve in communication with said exhaust passageway and said accompanying center opening in communication with said arcuate passageway to allow burnt gases to be expelled from said combustion chamber.

2. A rotary valve internal combustion engine as set forth in claim 1 wherein said ignition means includes a spark plug mounted on said cylinder block in communication with said combustion chamber.

3. A rotary valve internal combustion engine as set forth in claim 1 wherein said crankshaft is connected to said piston by means of a piston rod.

* * * * *